United States Patent [19]

Tyrrell et al.

[11] Patent Number: 5,007,103

[45] Date of Patent: Apr. 9, 1991

[54] AUTOMATIC SHUT-OFF AND ALARM FOR ELECTRIC HEATER

[75] Inventors: Paul C. Tyrrell, Kansas City; Johannes B. Backes, Raytown, both of Mo.; David D. McCormick, Shawnee Mission, Kans.; John F. Jesse, Buckner, Mo.

[73] Assignee: Rival Manufacturing Company, Kansas City, Mo.

[21] Appl. No.: 260,881

[22] Filed: Oct. 21, 1988

[51] Int. Cl.[5] ..... H05B 1/02

[52] U.S. Cl. ..... 219/363; 219/347

[58] Field of Search ..... 219/363, 364, 358

[56] References Cited

U.S. PATENT DOCUMENTS

| | | | |
|---|---|---|---|
| 974,638 | 11/1910 | Brly . | |
| 2,590,600 | 3/1952 | Farr et al. . | |
| 2,707,745 | 5/1955 | Farr et al. . | |
| 2,732,543 | 1/1956 | Mogren . | |
| 2,914,647 | 11/1959 | Ganske et al. . | |
| 3,019,324 | 1/1962 | Sohn . | |
| 3,066,202 | 11/1962 | Kaleba et al. . | |
| 3,175,059 | 3/1965 | Chesnut . | |
| 3,201,548 | 8/1965 | Mertler . | |
| 3,271,546 | 9/1966 | Chesnut . | |
| 3,314,411 | 4/1967 | Power . | |
| 3,385,287 | 5/1968 | Lawson et al. . | |
| 3,414,858 | 12/1968 | Huffman et al. . | |
| 3,487,394 | 12/1969 | Lee . | |
| 3,617,973 | 11/1971 | Chesnut | 337/375 |
| 3,637,981 | 1/1972 | Swimmer | 219/347 |
| 3,731,247 | 5/1973 | Levinn | 337/140 |
| 3,774,012 | 11/1973 | Vogel et al. | 219/499 |
| 3,878,539 | 4/1975 | Gooding | 340/274 |
| 3,906,478 | 9/1975 | Smey | 340/279 |
| 3,936,786 | 2/1976 | Petersen et al. | 337/80 |
| 4,127,854 | 11/1978 | Gardner et al. | 340/640 |
| 4,302,663 | 11/1981 | Chesnut | 219/497 |
| 4,580,038 | 4/1986 | O'Loughlin | 219/506 |
| 4,755,653 | 7/1988 | Townsend et al. | 219/358 |

FOREIGN PATENT DOCUMENTS

| | | |
|---|---|---|
| 434861 | 10/1924 | Fed. Rep. of Germany . |
| 836521 | 4/1952 | Fed. Rep. of Germany . |
| 1059127 | 11/1959 | Fed. Rep. of Germany . |
| 2716863 | 11/1977 | Fed. Rep. of Germany . |
| 2658731 | 6/1978 | Fed. Rep. of Germany . |
| 8405529 | 1/1986 | Fed. Rep. of Germany . |
| 2301989 | 9/1976 | France . |
| 423667 | 7/1947 | Italy . |
| 51-118528 | 9/1976 | Japan . |
| 52-56454 | 4/1977 | Japan . |
| 55-103791 | 7/1980 | Japan . |

*Primary Examiner*—Roy N. Envall, Jr.
*Attorney, Agent, or Firm*—Willian Brinks Olds Hofer Gilson & Lione

[57] ABSTRACT

An electric heater assembly which provides an alarm warning when an abnormal condition occurs and which simultaneously disables the electrical heating elements is provided. The heater element assembly includes a heating element, an electrically actuated alarm which provides an alarm warning when an abnormal condition occurs, and a tip-over switch which provides a closed circuit when the heater is in a predetermined level position and which provides an open circuit when the heater is tilted beyond a selected tilt angle. The electrical heating element, electrically actuated alarm, and tip-over switch are electrically connected such that the tip-over switch disables the heating element and actuates the alarm when the tip-over switch is in one of the open and closed positions, and such that the tip-over switch enables the heating element and disables the alarm when the tip-over switch is in the other of the open closed positions.

27 Claims, 2 Drawing Sheets

AUTOMATIC SHUT-OFF AND ALARM FOR ELECTRIC HEATER

BACKGROUND OF THE INVENTION

This invention relates generally to electric resistance heaters and more specifically to an abnormal condition detection system for use in electrical resistance heaters, wherein the system will automatically shut-off the heater upon detection of an abnormal condition and simultaneously generate an alarm warning.

Safety considerations with regard to electric appliances and particularly with regard to electrical resistance type space heaters have led to the incorporation of various safety features in such heaters. Two primary safety features which have been included in prior designs are systems for effectively shutting off the electrical heater if the temperature of the heating element exceeds a predetermined threshold temperature and systems for shutting off the electric heater if the electric heater is tipped over or tilted beyond a predetermined upright or level position. These two safety features are desirable since either of these conditions may constitute a serious safety hazard if the heater is not effectively disabled upon the occurrence of these events.

An example of an electric space heater safety system which includes a gravity actuated tip-over switch is disclosed in U.S. Pat. No. 3,637,981 (Swimmer). The tip-over switch includes a weighted member which maintains a vertical position resulting from the force of gravity. An operating member attached to the weighted member urges a pair of electrical contacts apart, thereby opening the circuit for the heating element when the heater is tilted beyond a predetermined angle.

U.S. Pat. Nos. 3,201,548 (Mertler) and 3,271,546 (Chesnut) each disclose systems including a combined thermostat and tip-over switch which may be used with electrical appliances such as with electrically heated appliances. In the systems disclosed by these two references, the appliance is de-energized by the separation of a single set of electrical contacts. The systems include a gravity actuated pendulum type tip-over switch to separate the electrical contacts when the appliance is tilted beyond a predetermined level upright position. The thermostat/tip-over switch also includes a set of bimetallic blades which are responsive to temperature changes. The bimetallic blades are used to separate the contacts when the temperature exceeds a predetermined adjustable level.

Although the above described devices will effectively disable the heating element of an electrical resistance type heater when the heater is either tilted beyond a predetermined tilt angle or when the heater exceeds a predetermined operating temperature, these devices do not generally provide any indication to the user that an abnormal condition has occurred. It is desirable to provide the user with a warning signal in order for the user to take appropriate steps to correct any hazardous condition which may arise due to the abnormal operation of such heaters.

To this end, the arrangement disclosed in U.S. Pat. No. 4,755,653 (Townsend et al.) comprises a heater assembly which includes an alert indicator. The alert indicator warns the user when the heater either exceeds a predetermined safe operating temperature or is tilted beyond a safe tilt angle. The alert indicator includes a buzzer and a pilot light to provide a visual and aural warning to the user when an abnormal condition has occurred. The buzzer and pilot light are activated by a tip-over switch which is normally in an open condition when the heater is in a normal upright level position. When the heater is tilted, the tip-over switch closes to activate the buzzer and pilot light. A thermostat which includes a second tip-over switch is used to disable the heating element when the heater is tilted beyond a predetermined level position. The system also includes a temperature limit control which disables the heating elements when the temperature exceeds a predetermined temperature. The temperature limit control includes a single-pole, double-throw switch with two sets of contacts. A first set of contacts, normally in a closed position, enables the heating elements when the heater is operating below the predetermined temperature. A second set of contacts, normally in an open position, closes to activate the buzzer and pilot light when the heater exceeds the predetermined temperature.

Although the system disclosed by Townsend et al provides the desired alarm warning, the system is not without limitations. Since the system includes two separate tip-over switches, one to disengage the heating elements and another to activate the alarm, any variance between the settings of the two tip-over switches may reduce the effectiveness of the alarm system. If the two tip-over switches operate at different angles from one another, it is possible that the heating elements may be disabled while the alarm system is not actuated or that the alarm may be actuated without the heating element being disabled. In either case, the effectiveness of the alarm system is reduced. Further, it is desirable to minimize the number of tip-over switches used in a heater for purposes of manufacturing economy.

It is therefore desirable to provide a system which includes an alarm system wherein the alarm system will be actuated by the same tip-over switch which disables the heating element. It is also desirable to provide a system wherein the alarm will also be actuated by a temperature limit control switch which disables the heating element of the heater.

Therefore, in view of the above, it is a general object of the present invention to provide a heater assembly wherein the same tip-over switch disables the resistive heating element and actuates an alarm system.

It is a further object of the present invention to provide a system which requires only a single tip-over switch to disengage the heating element and actuate an alarm system.

It is still a further object of the present invention to provide a heater assembly wherein a temperature limit control switch disables the heating element and simultaneously actuates an alarm system.

SUMMARY OF THE INVENTION

To achieve the foregoing and other objects and in accordance with the purposes of the present invention, the heater assembly of the present invention may include a heating element, an electrically actuated alarm and a tip-over switch which provides a closed circuit when the heater is in a predetermined level position and an open circuit when the heater is tilted beyond a selected tilt angle. The alarm, heating element and tip-over switch can be electrically connected such that the tip-over switch disables the heating element and actuates the alarm when the tip-over switch is in one of the open and closed positions and such that the tip-over switch enables the heating element and disables the alarm when the tip-over switch is in the other of the open and closed positions.

In a preferred embodiment, the tip-over switch and the alarm are electrically connected in parallel and the parallel combination of the tip-over switch and the alarm are connected in series with the electrical heating element.

Thus, the arrangement of the present invention provides a system wherein the heating element is disabled by a tip-over switch which provides an open circuit when the heater is tilted beyond a predetermined tilt angle and wherein an alarm is automatically actuated when the tip-over switch provides one of the open and closed circuits. The system of the present invention does not require any further mechanical process, such as the movement of a second tip-over switch or the closure of an additional set of contacts, to actuate the alarm. The arrangement of the present invention therefore provides a more reliable system than systems which require further mechanical operations to enable or actuate the alarm.

Additional objects, advantages and novel features of the invention will be set forth in part in the description which follows, and in part will become apparent to those skilled in the art upon examination of the following or may be learned by practice of the invention. The objects and advantages of the invention may be obtained by means of the combinations which are particularly pointed out in the appended claims.

DETAILED DESCRIPTION OF THE PRESENTLY PREFERRED EMBODIMENTS

Figure 1:
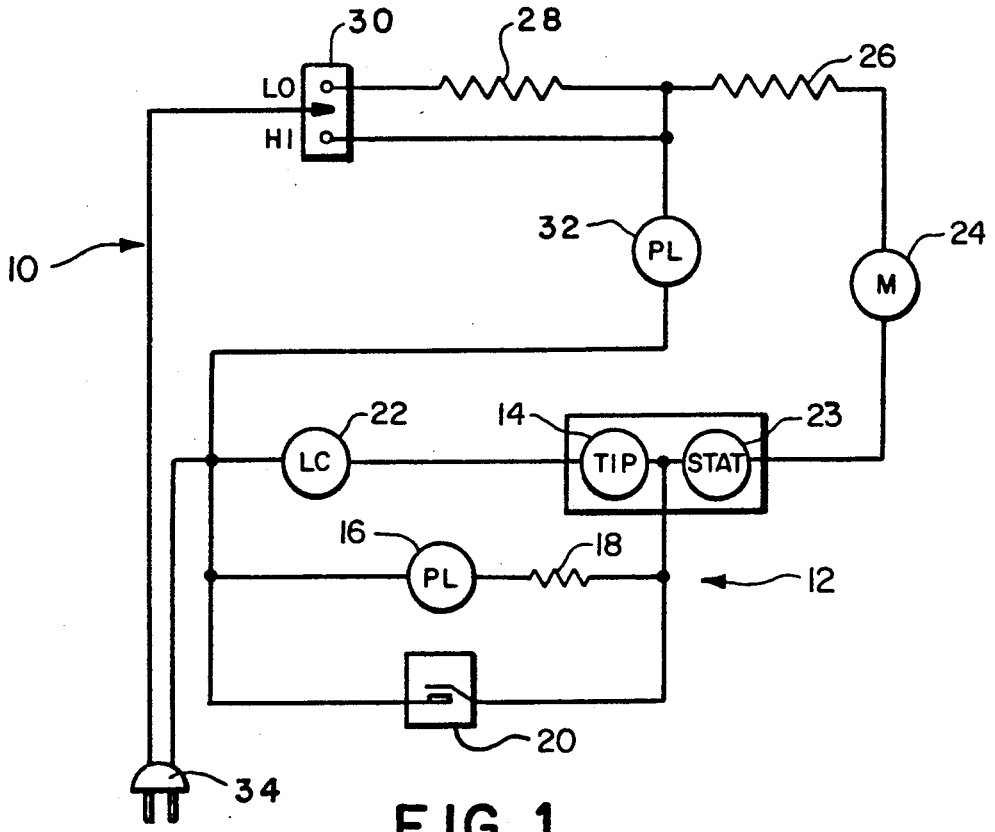
FIG. 1 is an electrical schematic representation of a first preferred embodiment of the heating element assembly of the present invention.

Referring now to the drawings, and specifically to FIG. 1, an electric heater assembly 10 includes a heating element 26, an alarm 12 and a tip-over switch 14. The heating element 26, alarm 12 and tip-over switch 14 may be connected by any suitable electrical circuit (1) which provides an arrangement wherein the tip-over switch 14 simultaneously disables the heating element 26 and actuates the alarm 12 when the heater is tilted beyond a predetermined angle and (2) which enables the heating element 26 and disables the alarm 12 when the heater is in a normal upright position. In the preferred embodiment illustrated, the alarm 12 is electrically connected in parallel with the tip-over switch 14 and the resistive heating element 26 is in turn connected in series with the parallel combination of the tip-over switch 14 and the alarm 12. In this embodiment the tip-over switch 14 is disposed such that it provides an open circuit therethrough when the heater is tilted beyond a predetermined upright position and a short circuit therethrough when the heater is in a normal level position.

When the heater is in a normal level or upright position the short circuit provided by the tip-over switch 14 provides a direct electrical path to the resistive heating element 26, such that the voltage drop across the alarm 12 is substantially zero. When the heater is tilted beyond the predetermined angle, the open circuit provided by the tip-over switch 14 forces current in the circuit to pass through the alarm 12, thereby actuating the alarm 12. As described in more detail below the electrical resistance of the alarm 12 is preferably several orders of magnitude greater than the electrical resistance of the heating element 26. Therefore, when the alarm 12 is actuated, substantially all of the electric power in the circuit will be dissipated by the alarm 12, thereby disabling the heating element 26.

The alarm 12 may be any suitable means which provides the user with a warning. Preferably, the alarm 12 includes an electrically actuated audible alarm such as a coil type buzzer 20. The alarm 12 may further include a visual alarm means such as a pilot light 16. The pilot light 16 is preferably connected in series with a resistor 18 to provide a sufficiently high resistance to disable the heating element 26 when the alarm is actuated. Preferably the buzzer 20 and the pilot light 16 are connected in parallel. For reasons explained below, the buzzer 20 and pilot light 16 are preferably of the type which fail in an open circuit condition.

A suitable buzzer 20 is available from U.S. Controls Corp. (New Berlin, Wis.) as model No. 10189 which has a resistance of approximately 2.1K OHMS measured at the lead wires. A suitable pilot light 16 is a neon lamp available from several commercial sources. In an exemplary embodiment the resistor 18 connected in series with the pilot light 16 has a resistance of 30K OHMS.

The heater assembly 10 may include a temperature limit control switch 22 having a temperature sensing element. The temperature limit control switch 22 is preferably connected in series with the tip-over switch 14 and the series combination of the tip-over switch 14 and the temperature limit control switch 22 is preferably connected in parallel with the alarm means 12. In this preferred embodiment the temperature limit control switch 22 provides a short circuit therethrough when operating under normal conditions and provides an open circuit therethrough when the sensing element of the temperature limit control switch 22 detects that the temperature of the heater assembly 10 has exceeded a predetermined safe operating temperature.

In a preferred embodiment the heater assembly 10 further includes a thermostat 23 which is used to select the normal operating temperature of the heater assembly 10. The thermostat 23 regulates the temperature of the heater assembly 10 by disabling the heater element 26 at a predetermined temperature. The thermostat 23 is preferably connected such that one of the connecting terminals of the thermostat 23 is electrically connected at the node between the tip-over switch 14 and the alarm 12. In this manner, cycling of the thermostat contacts will not actuate the buzzer 20 or pilot light 16.

A suitable tip switch/thermostat is available as a single unit from Norstat (Norwalk, Ohio), type SB509M or from Bimet (Morris, Ill.). type TPS-22. These single unit tip switch/thermostat devices include a mercury type tip-over switch and include an additional connection point between the thermostat and tip-over switch. It will be recognized by those skilled in the art that the tip-over switch 14 and the thermostat 23 are available as individual components from several commercial sources which are well suited for the purposes of the present invention. A suitable temperature limit control switch is available from Therm-O-Disc (Mansfield, Ohio).

A second heating element may be included to provide the user with a range of operating temperatures for the heater assembly 10. In the preferred embodiment of FIG. 1, a second heating element 28 is connected in series with the first heating element 26. A switch 30 which includes two contacts enables the user to selectively short circuit the second heating element 28. When the lower heating element 28 is added to the heating element 26 a higher resistance is provided thereby yielding a lower wattage at the same input voltage (preferably of 120 volts AC). In this manner, the user can select whether the heater is to be operated in a high mode of operation by short circuiting the second resistive heating element 28 or whether the heater is to be operated in a low mode of operation by connecting both the resistive elements 26 and 28 in series.

In an exemplary embodiment, the resistive element 26 has a resistance of 9.6 OHMS and the resistive heating element 28 has an electrically resistance of 1.5 OHMS when measured at room temperature.

The heater assembly 10 may further include a fan including a fan motor 24 to further enhance the heating capabilities of the heating assembly 10. The fan motor 24 may be any suitable electric fan motor and is preferably connected in series between the first heating element 26 and the thermostat 23.

The heater assembly 10 may further include a second pilot light 32 which will provide a signal to indicate whenever the heater assembly 10 is in an "on" condition. This second pilot light 32 is preferably connected such that it always bypasses the tip-over switch 14, temperature control switch 22 and alarm 12. In this manner, the second pilot light 32 will indicate that the unit is in an "on" condition independent of the state of the temperature limit control 22 or tip-over switch 14.

The heater assembly 10 may be connected to a power supply, such as an AC power supply, by any suitable means and preferably by means of a polarized plug 34.

Figure 2:
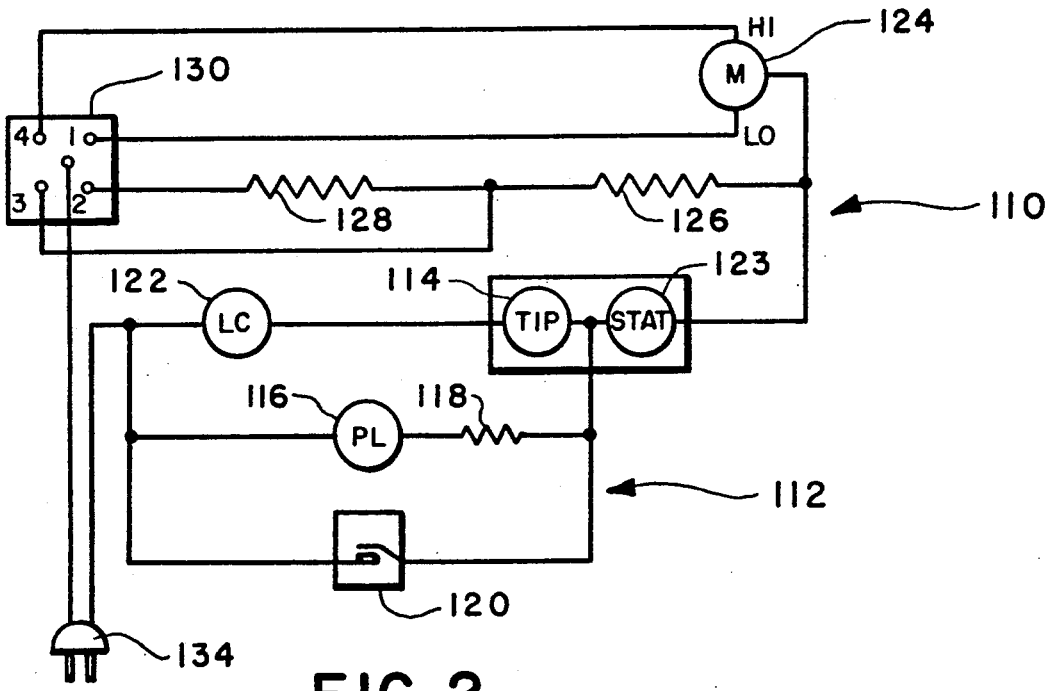
FIG. 2 is an electrical schematic of a second preferred embodiment of the heating element assembly of the present invention.

FIG. 2 illustrates a second preferred embodiment of the present invention wherein a heater assembly 110 includes an alarm 112 connected in parallel with a tip-over switch 114 and wherein the parallel combination of the tip-over switch 114 and the alarm 112 is connected in series with a first resistive heating element 126. Similar to the embodiment of FIG. 1, this preferred embodiment of FIG. 2 includes a pilot light 116 connected in series with a resistor 118 and a buzzer 120 which define the alarm 112.

A temperature limit control switch 122 which also provides an open circuit when the temperature of the heating element 110 exceeds a predetermined safe value is connected in series with the tip-over switch 114 and in parallel with both the pilot light 116 and the buzzer 120.

A thermostat 123 is provided between the tip-over switch 114 and the heating element 126. Preferably, the tip-over switch 114 and thermostat 123 are provided as a single unit with an additional connection point between the thermostat and the tip-over switch. Similarly to the arrangement of FIG. 1 this preferred embodiment of FIG. 2 allows the tip-over switch 114 to perform both of the functions of enabling or actuating the alarm 112 and disabling the resistive heating element 126.

In the embodiment of FIG. 2, a four contact switch 130 is electrically connected between the resistive element 126, a second resistive element 128 the motor 124 of an electric fan. This arrangement allows the user to selectively operate the heating elements of the heater at a high mode of operation by selectively short circuiting the second resistive heating element 128 or at a low mode of operation by connecting both heating elements 126, 128 in series. This arrangement also permits the user to operate the fan motor at either a high setting when the heating elements 26, 28 are disabled or a low setting when either heating element 28 is short circuited or when both heating elements 26, 28 are connected. These various modes of operation provide the user with a wide range of alternatives for the heater settings.

Suitable resistive heating elements for the embodiment of FIG. 2 include a high heating element 126 with an electrical resistance of 8.5 OHMS and a heating element 128 with an electrical resistance of 1.4 OHMS when measured at room temperature. It will be recognized by those skilled in the art that these are approximate resistances and that any suitable resistance may be used depending on the use contemplated.

The heater assembly 110 also includes suitable means such as a polarized plug 134 for connecting the heater assembly 110 to a power supply.

With the heater element assembly described with the preferred embodiments of FIGS. 1 and 2, the tip-over switch will disable the heating elements of the heater assembly when the heater is tipped or tilted beyond a predetermined safe tilt angle. Similarly, the temperature limit control switch disables the heating elements when the heating elements exceed a predetermined threshold temperature. The temperature limit control and tip-over switch are connected such that when an abnormal condition exists the heating elements are disabled simultaneously with the actuation the alarm. In the system of the present invention, the tip-over switch and temperature limit control each serve two functions. Thus, only a single tip-over switch is used both to disable the heating element and to actuate the alarm. Similarly a single temperature limit control switch is used to both disable the heating element and actuate the alarm. With the arrangement of the present invention the chances are minimized that when an abnormal condition occurs the alarm will not be actuated or that the alarm will be actuated without an abnormal condition occurring.

Since both the alarm pilot light and the buzzer are of the type which fail with open circuits, the failure mode of these components does not compromise the safety of the heating element by short circuiting either the temperature limit control switch or the tip-over switch. Since the alarm pilot light and the buzzer are preferably connected in parallel, either one will function as intended independent of whether the other one fails. The arrangement of the present invention, thus, enhances the reliability of the alarm system without compromising the system's abnormal condition shut-off capabilities.

Further, since a single tip-over switch is used to actuate the alarm and disable the heating element, a more economical design is provided those designs presently available in the art.

Figure 3:
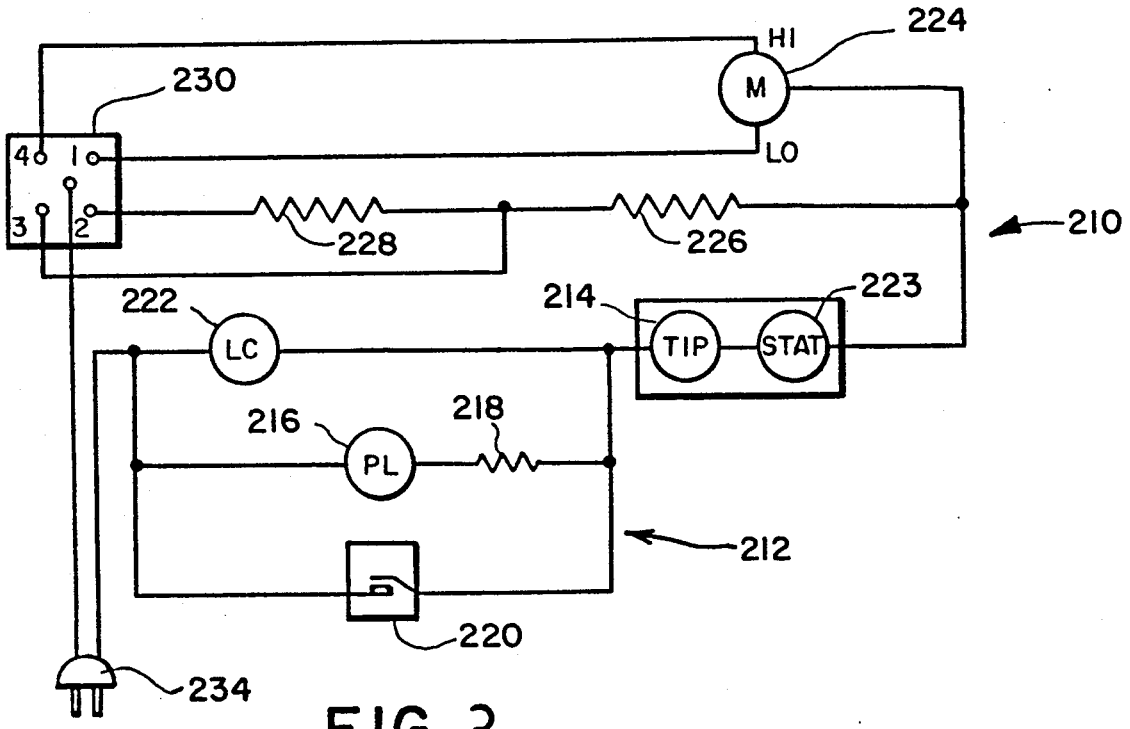
FIG. 3 is an electrical schematic of a third preferred embodiment of the heating element assembly of the present invention.

FIG. 3 illustrates another preferred embodiment of the present invention. In the embodiment of FIG. 3, the temperature control limit switch 222 is connected in parallel with the alarm 212. As in the embodiments of FIGS. 1 and 2, the alarm 212 preferably includes a pilot light 216 and a buzzer 220 connected in parallel with each other. The temperature control limit switch 222 is preferably of the type which provides an open circuit therethrough when the switch 222 senses that a predetermined temperature has been exceeded and provides a closed circuit therethrough under normal operation. In this embodiment the tip-over switch 214 is connected in series with the parallel combination of the temperature control limit switch 222 and the alarm 212. The rest of the elements in this embodiment are similar to the elements of the embodiment of FIG. 2.

The heater assembly 210 of this embodiment provides a more reliable temperature control and alarm arrangement than presently available arrangements. When the temperature control switch 222 senses that the temperature has exceeded the preset temperature thereby providing an open circuit, the alarm is automatically actuated by the opening of the circuit and the heating elements 228, 226 are automatically disabled. Unlike prior art designs there is no need for a switch arm to close a set of contacts to actuate the alarm. Thus, the possibility that the alarm will not be properly actuated if the switch arm malfunctions is eliminated.

The foregoing description of the preferred embodiments of the present invention has been presented for purposes of illustration and description. These embodiments are not intended to be exhaustive, nor is it intended to limit the invention to the precise forms disclosed in view of the many modifications and variations that are possible in light of the above teachings. The embodiments were chosen and described in order to best explain the principles of the invention and its practical applications, to thereby enable others skilled in the art to best utilize the invention in various embodiments and with various modifications as are suited to the particular use contemplated. It is intended that the scope of the invention be defined by the following claims, including all equivalents.

I claim:

1. An electric heater assembly comprising:

at least one electrical heating element;

an electrically actuated alarm for providing an alarm warning upon actuation;

a tip-over switch having a closed position in which a short circuit is provided therethrough when said heater is in a predetermined level position and having an open position in which an open circuit is provided therethrough when said heater is tilted beyond predetermined tilt angle; and circuit means for electrically connecting said heating element, said tip-over switch and said alarm such that said tip-over switch disables said heating element and actuates said alarm when said tip-over switch is in one of said open and closed positions and such that said tip-over switch enables said heating element and disables said alarm when said tip-over switch is in the other of said open and closed positions.

2. The electric heater assembly of claim 1 wherein said circuit means electrically connects said heating element, said tip-over switch and said alarm such that said tip-over switch disables said heating element and actuates said alarm when said tip-over switch is in said open position and such that said tip-over switch enables said heating element and disables said alarm when said tip-over switch is in said closed position.

3. The electric heater assembly of claim 1 further comprising:

a temperature control switch including a sensing element, said temperature control switch having a closed position in which a short circuit is provided therethrough when said sensing element senses the temperature of said heater to be below a predetermined threshold value and having an open position in which an open circuit is provided therethrough when said sensing element senses the temperature of said heater to exceed said threshold value; and temperature control circuit means for electrically connecting said heating element, said temperature control switch and said alarm such that said temperature control switch disables said heating element and actuates said alarm when said temperature control switch is in said open position and such that said temperature control switch enables said heating element and disables said alarm when said temperature control switch is in said closed position.

4. The heater assembly of claim 1 wherein said circuit means comprises a tip-over switch circuit wherein said alarm and said tip-over switch are electrically connected in parallel and wherein said parallel combination is connected in series with said heating element.

5. The electric heater assembly of claim 4 wherein said alarm is of the type which fails in an open circuit condition.

6. The electric heater assembly of claim 4 further comprising a temperature control switch including a sensing element, said temperature control switch having a closed position in which a short circuit is provided therethrough when said sensing element senses the temperature of said heater to be below a predetermined threshold value and having an open position in which an open circuit is provided therethrough when said sensing element senses the temperature of said heater to exceed said threshold value, wherein said temperature control switch is connected in series with said tip-over switch and said series combination of said tip-over switch and said temperature control switch is connected in parallel with said alarm.

7. The electric heater assembly of claim 4 further comprising a heater thermostat connected in series with and between said heating element and said parallel combination of said alarm and said tip-over switch.

8. The electric heater assembly of claim 7 further comprising a temperature control switch including a sensing element, said temperature control switch having a closed position in which a closed circuit is provided therethrough when said sensing element senses the temperature of said heater to be below a predetermined threshold value and having an open position in which an open circuit is provided therethrough when said sensing element senses the temperature of said heater to exceed said threshold value, wherein said temperature control switch is connected in series with said tip switch and said series combination of said tip switch and said temperature control switch is connected in parallel with said alarm.

9. The electric heater assembly of claim 1 wherein said alarm comprises an electrically actuated audible alarm.

10. The electric heater assembly of claim 4 wherein said alarm comprises an electrically actuated audible alarm.

11. The electric heater assembly of claim 10 wherein said alarm further comprises a pilot light connected in parallel with said electrically actuated audible alarm.

12. The electric heater assembly of claim 8 further comprising an electric fan including an electric fan motor wherein said electric fan motor is connected in series with and between said electric heating element and said thermostat.

13. The electric heater assembly of claim 8 including a second heating element connected in series with said first heating element and means for selectively short circuiting one of said heating elements.

14. The electric heater assembly of claim 13 further comprising an electric fan including an electric fan motor, wherein said fan motor is connected in parallel with said heating elements.

15. An electric heater assembly comprising:

at least one electrical heating element;

an electrically actuated alarm for providing an alarm warning when said heater is tilted beyond a predetermined position; and a tip-over switch providing a closed circuit therethrough when said heater is in a predetermined level position, and providing an open circuit therethrough when said heater is tilted beyond a predetermined tilt angle;

wherein said alarm and said tip-over switch are electrically connected in parallel and wherein said heating element is connected in series with said parallel combination of said tip-over switch and said alarm.

16. The electric heater of claim 15 further comprising a heater thermostat electrically connected in series with and between said heating element and said parallel combination of said tip-over switch and said alarm.

17. The electric heater assembly of claim 15 further comprising a temperature limit control switch including a sensing element, said temperature control switch having a closed position in which a short circuit is provided therethrough when said sensing element senses the temperature of said heater to be below a predetermined threshold value and having an open position in which an open circuit is provided therethrough when said sensing element senses the temperature of said heater to exceed said threshold value, wherein said temperature control switch is connected in series with said tip-over switch and said series combination of said tip-over switch and said temperature control switch is connected in parallel with said alarm.

18. The electric heater assembly of claim 16 further comprising a temperature limit control switch including a sensing element, said temperature limit control switch having a closed position in which a short circuit is provided therethrough when said sensing element senses the temperature of said heater to be below a predetermined threshold value and having an open position in which an open circuit is provided therethrough when said sensing element senses the temperature of said heater to exceed said threshold value, wherein said temperature limit control switch is connected in series with said tip-over switch said series combination of said tip-over switch and said temperature control switch is connected in parallel with said alarm.

19. The electric heater assembly of claim 18 wherein said heater further includes a second heating element and means for selectively short circuiting one of said heating elements.

20. An electric heater assembly comprising:

at least one electric heating element;

an electrically actuated alarm for providing an alarm warning upon actuation;

a temperature control switch including a sensing element, said temperature control switch having a closed position providing a closed circuit therethrough when said sensing element senses the temperature of said heater to be below a predetermined threshold value and having an open position providing an open circuit therethrough when said sensing element senses the temperature of said heater to exceed said threshold value;

temperature control circuit means for electrically connecting said heating element, said temperature control switch and said alarm such that said temperature control switch disables said heating element and actuates said alarm when said temperature control switch is in said open position and such that said temperature control switch enables said heating element and disables said alarm when said temperature control switch is in said closed position;

wherein said temperature control circuit means comprises a temperature control limit switch circuit wherein said alarm and said temperature control switch are electrically connected in parallel and wherein said parallel combination is connected in series with said electrical heating element.

21. The heater assembly of claim 20 further comprising a heater thermostat connected in series with and between said electrical heating element and said parallel combination of said alarm and said temperature limit control switch.

22. The heater assembly of claim 21 further comprising a tip-over switch connected in series with and between said electrical heating element and the parallel combination of said alarm and said temperature limit control switch.

23. The electric heater of claim 20 wherein said alarm comprises an electrically actuated audible alarm.

24. The electric heater of claim 22 wherein said alarm comprises an electrically actuated audible alarm.

25. The electric heater of claim 24 wherein said alarm further comprises an electrical pilot light connected in parallel with said electrically actuated audible alarm.

26. The electric heater of claim 22 further comprising an electric fan including an electric fan motor wherein said electric fan motor is connected in series with and between said electric heating element and said thermostat.

27. The electric heater of claim 22 including a second heating element connected in series with said first heating element and means for selectively short circuiting one of said electric heating elements.

* * * * *